US005319842A

United States Patent [19]

Buckley et al.

[11] Patent Number: 5,319,842

[45] Date of Patent: Jun. 14, 1994

[54] SHEARING MECHANISM IN A MACHINE FOR ATTACHING A TERMINAL TO A CONDUCTOR

[75] Inventors: Richard A. Buckley, Camp Hill; Alden O. Long, Carlisle, both of Pa.

[73] Assignee: The Whitaker Corporation, Wilmington, Del.

[21] Appl. No.: 108,864

[22] Filed: Aug. 18, 1993

[51] Int. Cl.[5] ..... H01R 43/04

[52] U.S. Cl. ..... 29/566.2; 29/33 M

[58] Field of Search ..... 29/566.2, 564.4, 564.6, 29/753, 744, 566.3, 566, 33 M, 748

[56] References Cited

U.S. PATENT DOCUMENTS

| | | | |
|---|---|---|---|
| 3,911,712 | 10/1975 | Wustinger et al. | 29/751 X |
| 4,543,714 | 10/1985 | Seffernick et al. | 29/564.6 |
| 4,654,952 | 4/1987 | Baldyga | 29/566.2 |
| 4,707,913 | 11/1987 | Moline | 29/753 |
| 4,805,278 | 2/1989 | Bulanda et al. | 29/33 M |
| 4,896,419 | 1/1990 | Jürgenhake et al. | 29/566.2 X |
| 4,959,988 | 10/1990 | Dassance et al. | 29/566.2 X |
| 5,241,744 | 9/1993 | Legrady et al. | 29/566.2 X |

FOREIGN PATENT DOCUMENTS

| | | | |
|---|---|---|---|
| 2037207 | 7/1980 | United Kingdom | 29/566.2 |

*Primary Examiner*—William Briggs
*Attorney, Agent, or Firm*—Robert J. Kapalka

[57] ABSTRACT

A machine is disclosed for inserting terminals into cavities of a bobbin to terminate the ends of electrical windings. The machine includes a shear mechanism that separates the terminals from the carrier strip and then guides the terminals during insertion thereof. The shear mechanism includes a pair of links that form a toggle having a center pivot that is attached to the piston rod of an air cylinder. Movement of the toggle links in turn moves a pivoting lever that causes the shear blades to reciprocate. As the piston rod is made to extend, the links straighten and then pass center a small amount until a stop setscrew is engaged. As the links straighten the shear blades enter the die and sever the segments of carrier strip from the terminals. As the links pass over center the shear blade is partially withdrawn so that it clears features projecting from the sides of the terminals while a guide portion of the blade remains in guiding engagement with the severed terminals during insertion thereof.

10 Claims, 6 Drawing Sheets

SHEARING MECHANISM IN A MACHINE FOR ATTACHING A TERMINAL TO A CONDUCTOR

The present invention relates to machines for attaching a terminal to the ends of magnet wire wound around a bobbin, and in particular to a mechanism for separating the terminal from the carrier strip and guiding it during insertion into the bobbin.

BACKGROUND OF THE INVENTION

Existing machines for terminating the ends of electrical windings of bobbins must be able to accommodate different styles and types of terminals. In all cases the terminal is severed from the carrier strip by a cutting blade and then it is inserted into a terminal receiving cavity of the bobbin. During insertion, the cutting blade remains extended to guide the loose terminal. In cases where the terminal has a lug or other projection extending beyond the sides of the terminal, this projection must be cleared by the cutting blade during insertion. This is accomplished by withdrawing the cutting blade, after severing, just enough to clear the projection yet the blade remains close enough to guide the terminal. The mechanism for performing the withdrawal is usually a cam and follower structure. Typically, a member having a cam slot is attached to the end of the piston rod of the air cylinder that actuates the cutting blades. A follower that is attached to the end of a pivoting member engages the cam slot, the other end of the pivoting member being coupled to the cutting blades for operation thereof. As the piston rod of the air cylinder extends, the cam slot causes the follower to move the end of the pivoting member so that the cutting blades extend and sever the carrier strip then withdraw a specific amount. The terminal is then inserted and the air cylinder reversed so that the follower rides back along the cam slot reversing the withdrawal motion and then retracting the cutting blades. The cam and follower mechanism in such machines is expensive to manufacture and is usually different for different terminal applications, thereby requiring setup time. What is needed is a machine that has a shearing mechanism that is adjustable so that the amount of cutting blade withdrawal can easily be adjusted to a desired amount or to no withdrawal in cases where there are no projections.

SUMMARY OF THE INVENTION

A machine is disclosed for attaching terminals to the ends of an electric winding of a bobbin. The machine has a frame and a shearing mechanism supported by the frame for separating the terminals from the carrier strip and for guiding the terminals during insertion thereof into the bobbin. The shearing mechanism includes a die and a punch arranged for reciprocating motion toward and away from the die. The punch assumes a first position away from the die, a second position in mated shearing engagement with the die, and a third position wherein the punch is adjacent to but spaced from the die and is in guiding relationship with the terminal. The actuator means is operable in a forward direction to an extended position and a reverse direction to a retracted position for effecting the reciprocating motion of the punch. When the punch is in the first position the actuator means is in the retracted position, when the punch is in the third position the actuator means is in the extended position, and when the punch is in the second position the actuator means is between the retracted and extended positions.

DESCRIPTION OF THE PREFERRED EMBODIMENT

Figure 1:
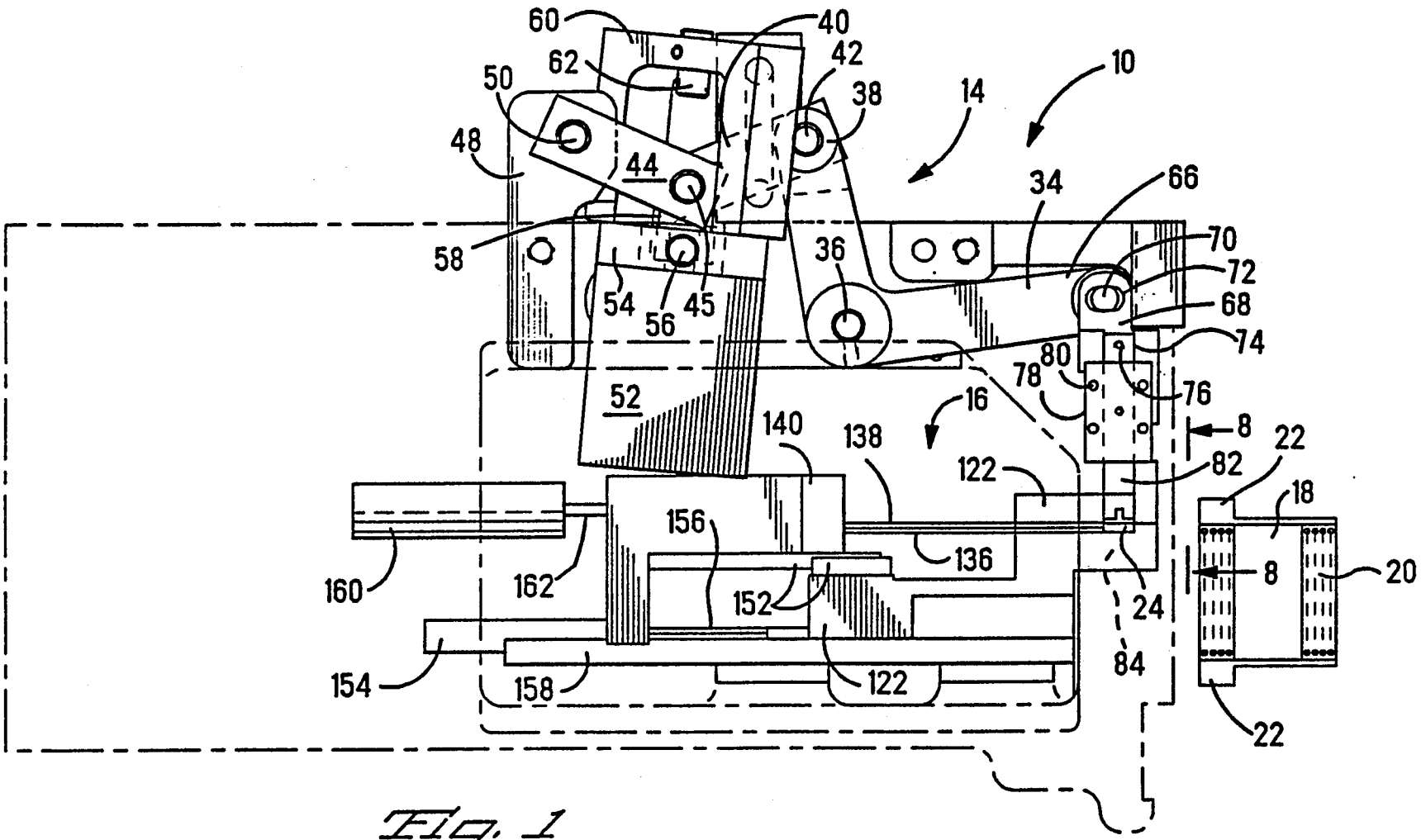
FIG. 1 is a side view of a terminal applicating machine incorporating the teachings of the present invention.
Figure 2:
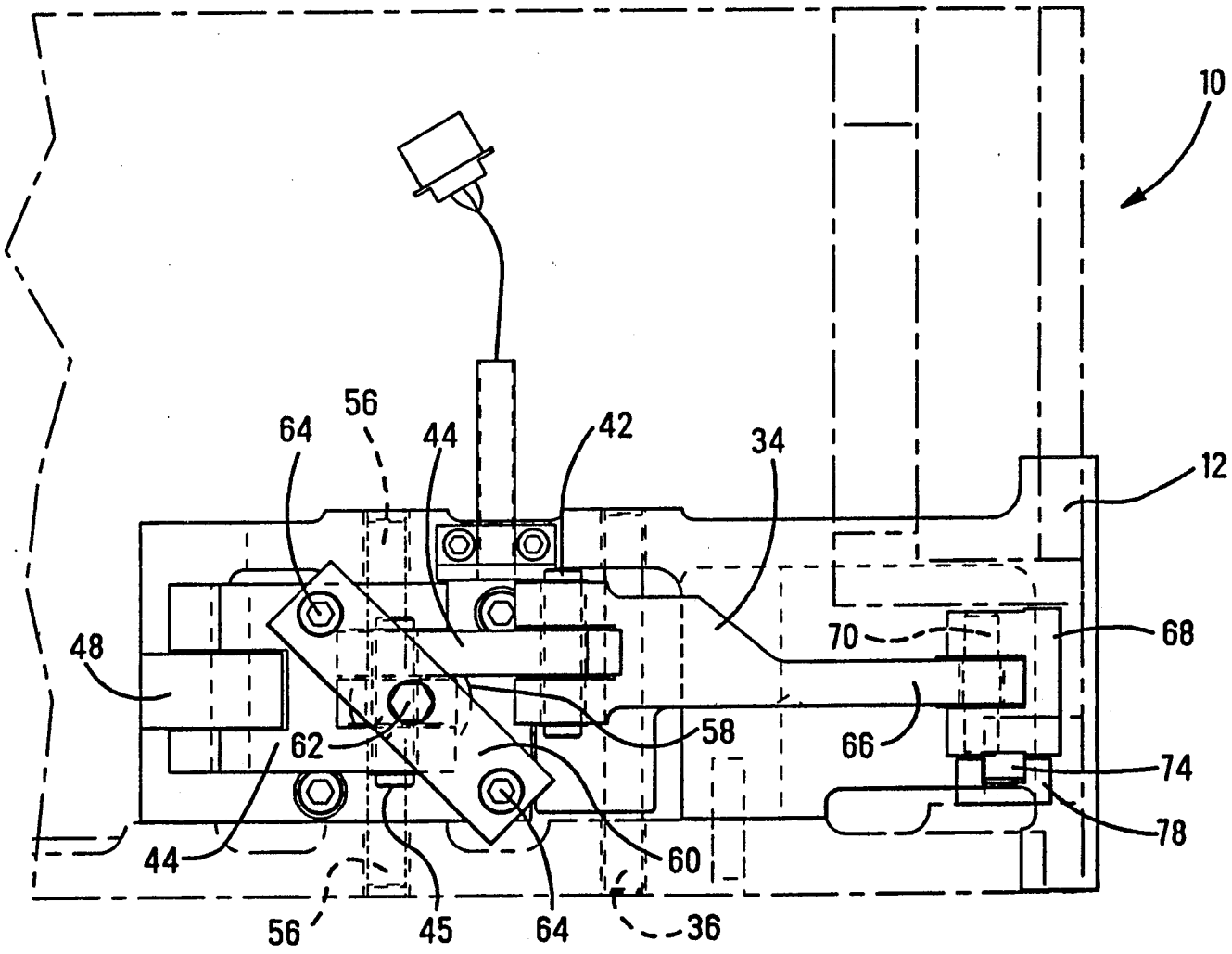
FIG. 2 is a plan view of the machine shown in FIG. 1.
Figure 3:
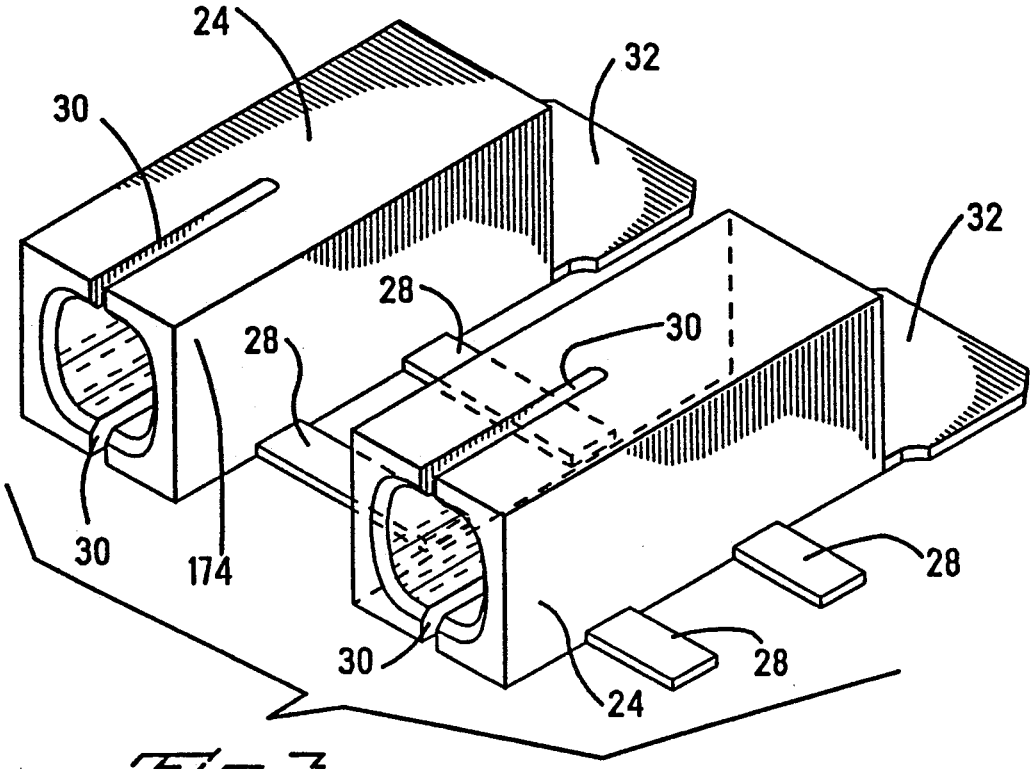
FIG. 3 is an isometric view of a portion of a strip of terminals of the type applied by the machine shown in FIG. 1.

There is shown in FIGS. 1 and 2 a machine 10 having a frame, a portion of which is shown at 12, a terminal shearing and guiding mechanism 14, and a terminal insertion mechanism 16, both of which are coupled to the frame. A typical bobbin 18 having an electrical winding 20 and terminal receiving cavities 22 is shown adjacent the machine 10 in position for receiving a terminal 24. The bobbin 18 is supported and positioned on tooling, not shown, that is specifically provided for each different bobbin application. A typical terminal 24 that is used to terminate the ends of the winding 20 is shown in FIG. 3. The terminals 24 are provided in strip form in the usual manner, interconnected by a two segment carrier strip 28. Each terminal has an insulation displacement slot 30 for receiving an end of the winding 20 and making electrical contact therewith. The other end of the terminal,in the present example, has a spade lug 32 projecting outwardly therefrom for interconnecting to other electrical components. This spade lug 32 is sometimes wider than the width of the body of the terminal 24, and therefore must be cleared by the shearing tool during severing and insertion of the terminal. This will be explained in more detail below.

The shearing and guiding mechanism 14, as shown in FIGS. 1 and 2, includes an L-shaped lever 34 that is pivotally attached to the frame 12 by means of the pin 36. One end 38 of the L-shaped lever is bifurcated to receive an end of a link 40 and the two are pivotally attached by means of the pin 42. The other end of the link 40 is pivotally attached to an end of an H-shaped link 44 by means of the pin 45, and the other end of the H-shaped link is pivotally attached to a projection 48 of the frame 12 by means of the pin 50, thereby forming a pair of toggle links. A linear actuator 52, an air cylinder in the present example, is attached to a trunion 54 which is pivotally attached to the frame 12 by means of a pair of pins 56. A clevis block 58 is attached to the piston rod of the cylinder 52 and has a hole through which the pin 45 passes, thereby coupling the piston rod of the air cylinder to the center pivot of the toggle links 40 and 44. A U-shaped member 60 having a setscrew 62 threaded therethrough is secured to the trunion 54 by means of the screws 64, the setscrew being in alignment with the clevis block 58 so that as the piston rod of the cylinder 52 is extended, the clevis block will abut the setscrew thereby limiting the travel of the piston rod. The other end 66 of the L-shaped lever is coupled to a shear blade holder 68 by means of a pin 70. The pin 70 extends through an elongated hole 72 formed in the end of the holder 68 and is sized to slide back and forth within the hole 72 with little or no appreciable play in the vertical direction, as viewed in FIG. 1. The holder 68 is attached to a movable member 74 of a slide assembly by the screws 76 while the stationary member 78 of the slide assembly is attached to the frame 12 by the screws 80 so that the holder will undergo reciprocating motion when the air cylinder 52 is actuated in both directions.

As shown in FIG. 1 a shear blade or punch assembly 82 is positioned directly above the terminal 24. A mating die block 84 is positioned below the terminal and supports it during separation of the terminal from the carrier strip. The shear blade assembly 82 and the die block assembly 84 are shown in detail in the exploded parts view of FIG. 4. There, the shear blade holder 68 is shown in relation to the shear blade assembly 82 which includes a pair of identical shear blades 86 separated by a spacer 88 having a thickness that is substantially the same as the width of the terminal 24. A holder block 90 is arranged adjacent the right most shear blade 86 and another holder 92, which is L-shaped, is arranged on the opposite side of the left most shear blade with a spacer block 94 therebetween. The parts 86, 88, 90, 92, and 94 are stacked together and positioned within a cavity 96 formed in the holder 68. A pair of roll pins are inserted into holes that are formed through all of the parts, including the holder 68, to position the shear blades in the desired alignment with their top surfaces 100 in abutting engagement with the top of the cavity 96. A pair of screws 102 extend through clearance holes in the block 68 and into threaded holes 104 in the holders 90 and 92.

Figure 4:
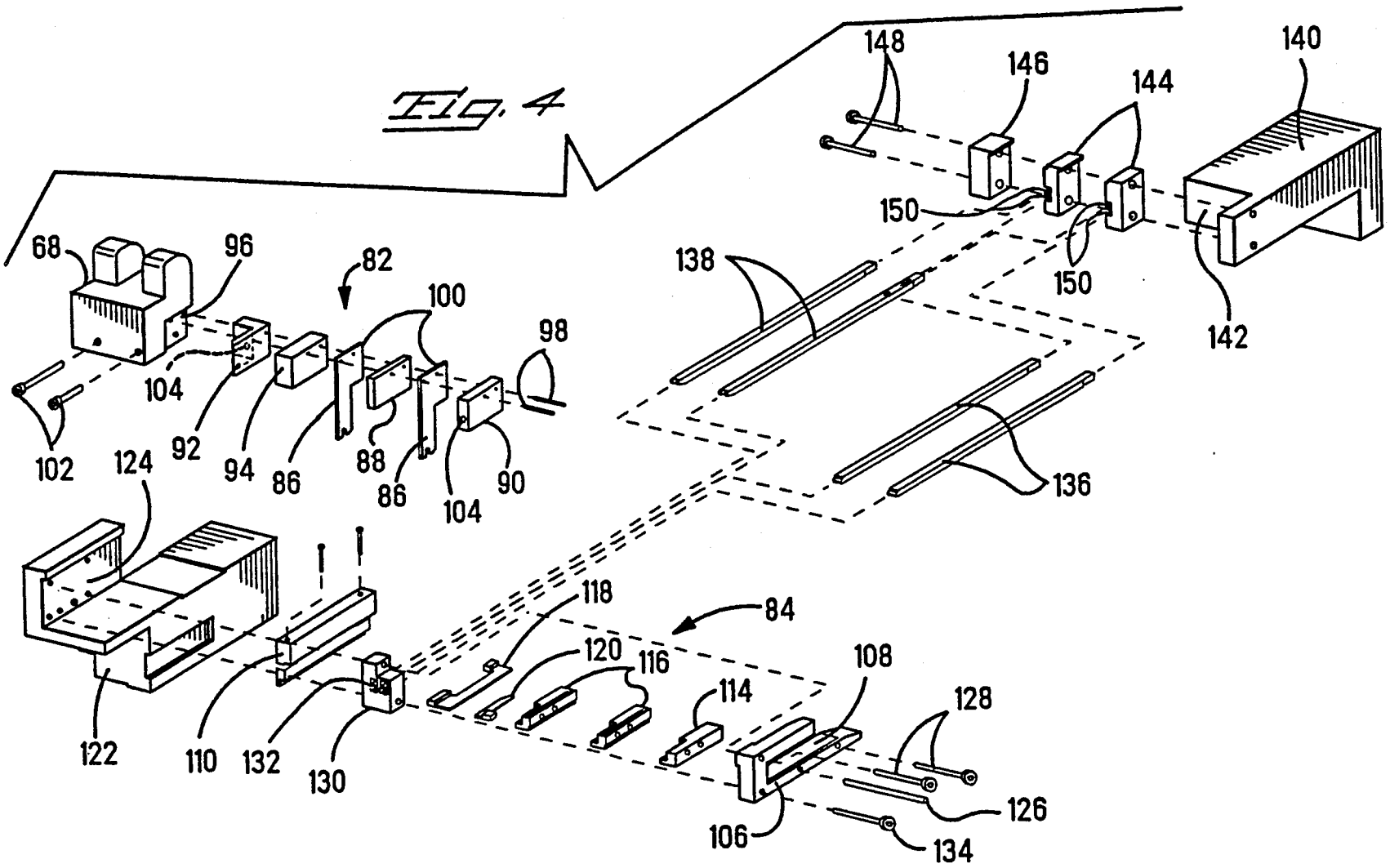
FIG. 4 is an exploded parts view showing portions of the shearing and insertion mechanisms of the machine.
Figure 6:
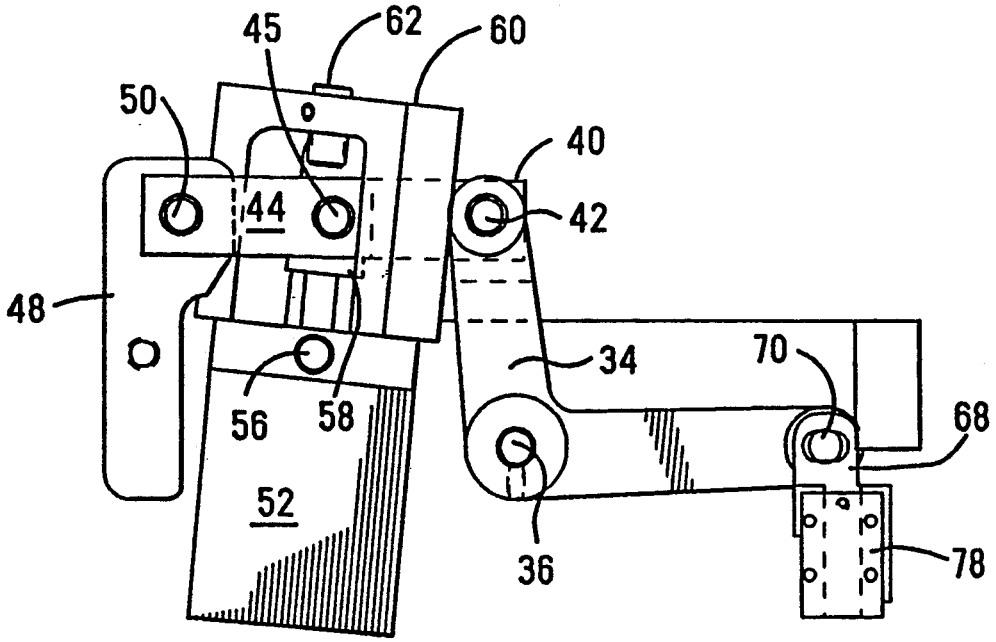
FIGS. 6 and 7 are side views of the shear actuating mechanism showing different operating positions.

The die block assembly 84, as viewed in FIG. 4, includes a right guide member 106 having a U-shaped opening 108 for receiving and guiding the strip of terminals 24 and a left guide member 110 for guiding the left most terminal after separation from the carrier strip. An outer shear block 114 is positioned adjacent the right guide member 106 and a pair of inner shear blocks 116 are positioned between the outer shear block and the left guide member 110. A pair of stripper plates 118 and 120 are positioned directly above the two inner shear blocks 116 to hold the terminals in place after shearing and during withdrawal of the shear blades 86. A first carriage 122 has an L-shaped nest 124 for receiving and positioning the die block assembly 84. A pin 126 and a pair of screws 128 secure the assembly to the first carriage 122, the screws threaded into holes in the carriage. A tool guide block 130 having four openings 132 therethrough is also part of this assembly and is positioned in front of the two inner shear blocks 116 and secured in place with a screw 134 that extends through the right and left guide members 106 and 110 and into a threaded hole in the first carriage 122. The purpose of the tool guide is to guide a pair of inserter blades 136 and a pair of cutoff blades 138 as shown in FIG. 4. There, a second carriage 140 is shown having a cutout 142 for receiving a pair of tool holders 144 and a clamping block 146, which are secured within the cutout by means of the screws 148. Each tool holder 144 has a pair of slots 150 sized to receive the ends of the insert blades 136 in the two lower slots and the two cutoff blades in the two upper slots. The depth of the slots 150 is less than the width of the blades so that when the screws 148 are tightened the blades 36 and 138 are rigidly clamped in place. The other ends of the blades 136 and 138 are aligned with the openings 132 in the guide block 130. As best seen in FIG. 1, the first and second carriages 122 and 140 are slidingly coupled together by means of a slide 152 which permits relative movement of the two carriages so that the two insertion blades and the two cutoff blade can be passed through the openings 132 for inserting the terminal into the bobbin and then withdrawn. An air cylinder 154 has its housing attached to the second carriage 140 and its piston rod 156 coupled to the first carriage 122. In operation, the cylinder 154 is normally energized so that the piston rod 156 is in its extended position. as shown in FIG. 1, for a purpose that will be explained. The assembly of the two carriages 122 and 140 and the air cylinder 156 is arranged on another slide 158, which has its stationary portion attached to the frame 12 of the machine. The slide 158 is arranged so that the insertion blades 136 will push the terminals 24 toward the bobbin 18 and into the terminal receiving cavities 22. This is accomplished by an air cylinder 160 having its housing attached to the frame 12 and the end of its piston rode 162 coupled to the carriage 140.

Figure 5:
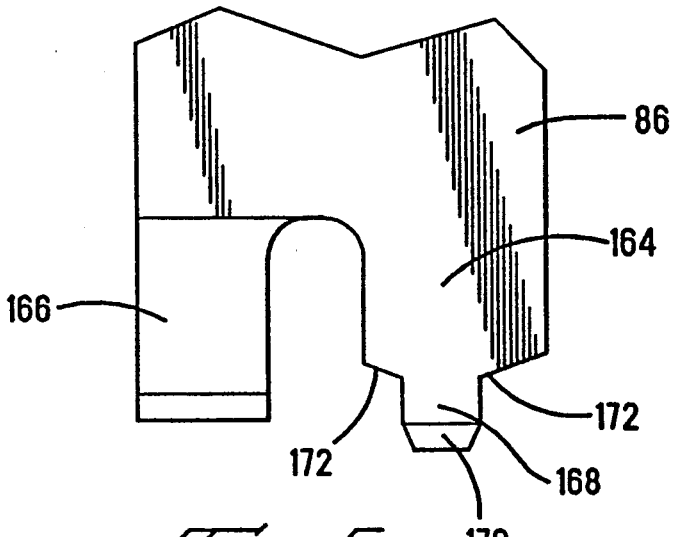
FIG. 5 is an enlarged view showing a portion of the cutting tool shown in FIG. 4.

There is shown in FIG. 5 an enlarged view of the tip of the shear blade 86 having a cutting portion 164 and a guide portion 166. The cutting portion has a leading end 168 that is sized to fit between the two carrier strip segments 28. A lead in chamfer 170 is provided on the end 168 to self center the terminal strip with the shear blade. A pair of cutting edges 172 angle outwardly from each side of the end 168 and interact with the shear blocks 114 and 116 to sever the segments 28 and separate the terminals 24 from the strip. The guide portion 166 is slightly undercut to provide sufficient clearance between the guide portion and the terminals 24 to prevent binding when the terminals are pushed by the blades 136 into the bobbin cavities.

Figure 7:
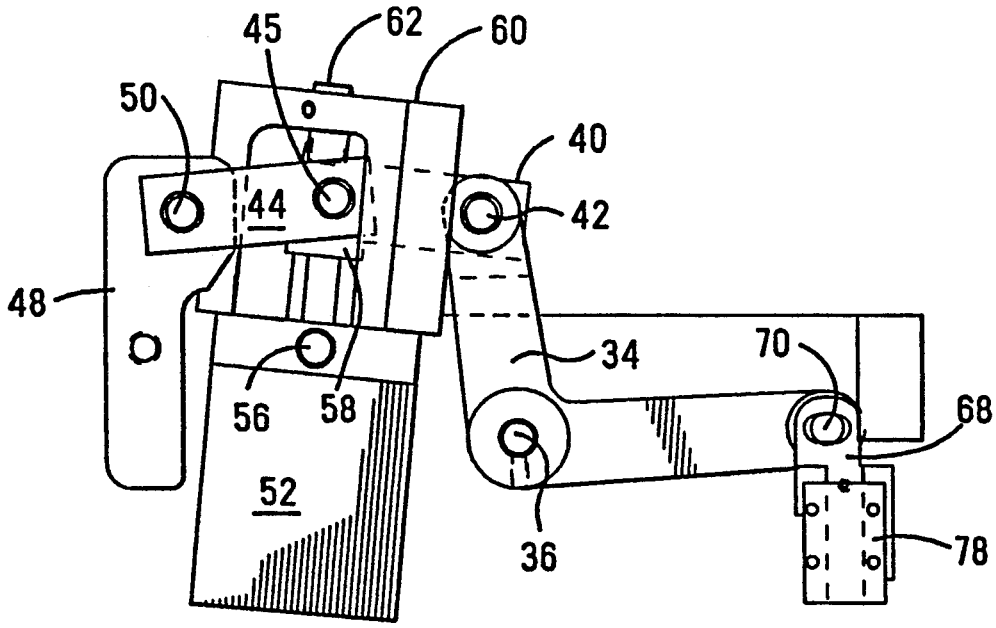
Figure 8:
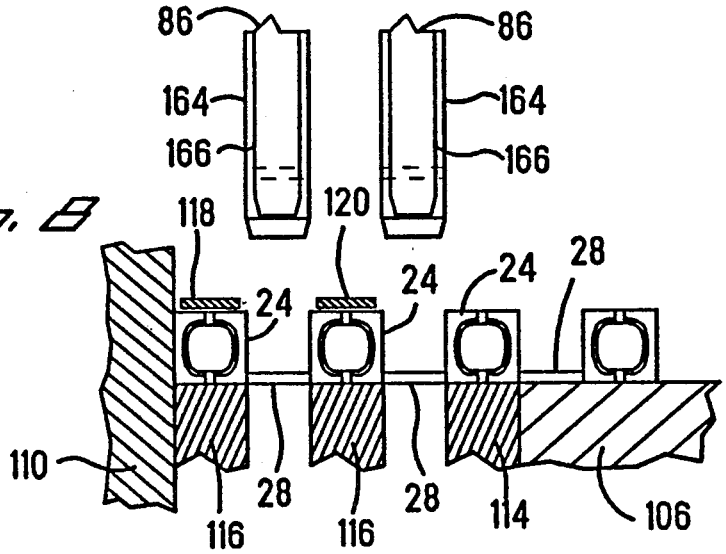
FIGS. 8, 9, and 10 are enlarged views taken along the lines 8—8 of FIG. 1 showing a portion of the shearing cutters.
Figure 9:
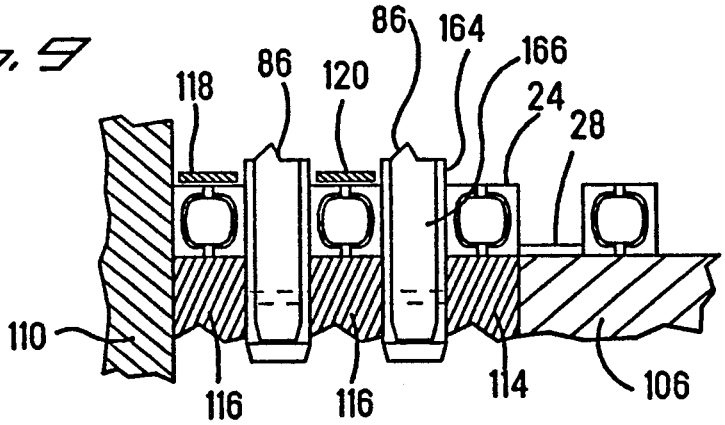
Figure 10:
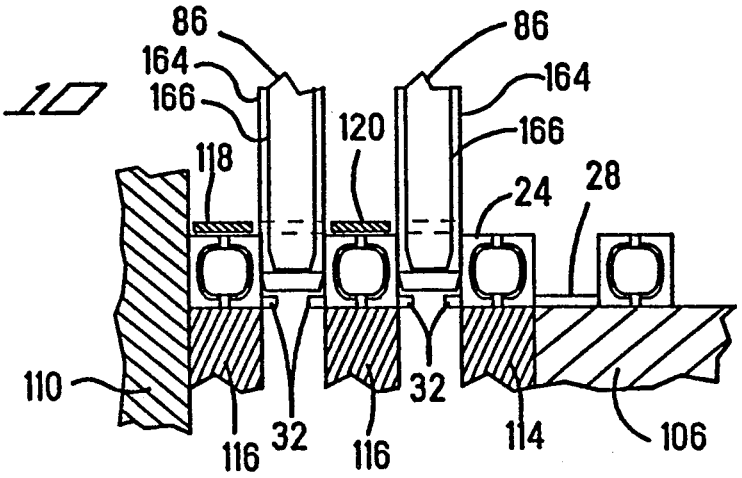

The operation of the machine 10 will now be described with particular reference to FIGS. 1 and 6 through 10. The starting position of the shearing and insertion mechanisms are as show in FIG. 1 with the cylinders 52 and 160 retracted and the cylinder 154 pressurized to its extended position. A bobbin 18 is arranged in position as shown in FIG. 1. A strip of terminals is loaded into the machine so that a pair of terminals 24 are in position over the shear blocks 116, as best seen in FIG. 8. The air cylinder 52 is then pressurized to extend its piston rod. As the toggle links 40 and 44 reach the position shown in FIG. 6, where the axes of the pivot pins 42, 45, and 50 are in a common plane, the lever arm 34 has pivoted a maximum amount about its pivot pin 36 thereby moving the tool holder 68 and the shear blades 86 downwardly to the position shown in FIG. 9. As the cutting edges 172 passed the upper surfaces of the shear blocks 114 and 116, the four segments 28, two segments between each terminal, were severed thereby separating the two terminals 24 from the carrier strip. As the piston rod of the cylinder 52 continues to extend, the center pivot pin 45 of the toggle links moves above the common plane where the top of the clevis 58 abuts the setscrew 62 thereby preventing further upward movement, as shown in FIG. 7. This movement of the pivot pin 45 over center causes the lever arm 34 to reverse direction and withdraw the shear blades 86 to a position slightly above the shear blocks 114 and 116, as shown in FIG. 10. While the guide portion 166 of each blade 86 remains within the space between adjacent severed terminals 24, the chamfered tip 170 is clear of the spade lugs 32. While the piston rod of the cylinder 52 remains extended, the air cylinder 160 is pressurized causing the two carriages 122 and 140 to move along the slide 158 toward the bobbin 18, as best seen in FIG. 1. This movement continues until the faces of the carriage 122 and the guide block 130 engage the face of the bobbin 18 and stop further movement of the carriage 122. However, since the air cylinder 160 is larger than the cylinder 154, the smaller one is overpowered allowing the second carriage 140 to move with respect to the first carriage 122 along the slide 152. This carries the insertion blades 136 and the cutoff blades 138 forward, picking up the two terminals and pushing them between the guide portions 166 toward and into the openings 132 of the guide block 130, through the guide block and into the terminal receiving cavities 22 of the bobbin 18. As the terminals seat in the cavities 22 the ends of the windings 20 are forced into the insulation displacement slots 30 of the terminals and the cutoff blades 138 trim off the excess wire ends. The pressurization of the air cylinder 160 is then reversed and the second carriage 140 withdrawn, thereby withdrawing the blades 136 and 138 to their original starting position relative to the first carriage 122 as the first carriage is held in engagement with the bobbin 18 by the air cylinder 154. As the cylinder 160 continues to retract, the cylinder 154 reaches its full extension allowing the first carriage to withdraw away from the bobbin and both first and second carriages to return to their starting positions shown in FIG. 1. The piston rod of the air cylinder 52 is then retracted thereby returning the toggle links 40 and 44 to their starting position shown in FIG. 1. The bobbin 18 can then be moved to place empty cavities 22 in position and the process repeated.

It will be appreciated that the tips of the shear blades 86 must clear the spade lugs 32, as viewed in FIG. 10, while the terminals are pushed by the insertion blades and yet the guide portion 166 must remain in guiding position with respect to the box portion 174 of the terminal 14. The position of these tips is governed by the extension of the piston rod of the air cylinder 52, which is limited by the setscrew 62. With the piston of the air cylinder fully extended, as shown in FIG. 7, the position of the tips of the shear blades 86 with respect to the shear blocks 114 and 116, as shown in FIG. 10, can be easily adjusted by adjusting the setscrew 62.

An important advantage of the present invention is that the shearing motion of the shear blades and their subsequent partial withdrawal for insertion of the terminal is accomplished with a single stroke of the air cylinder. This permits a much simplified structure of the actuating mechanism. Additionally, this conveniently permits a dwell prior to the return stroke so that the terminal can be inserted into the bobbin, without any additional structure that would otherwise be required to provide the delay.

We claim:

1. In a machine for attaching terminals to the ends of an electric winding of a bobbin, wherein said machine has a frame, a shearing mechanism supported by the frame for separating the terminals from the carrier strip and for guiding the terminals during insertion thereof into the bobbin, comprising:

(a) a die (b) a punch arranged for reciprocating motion toward and away from said die, wherein said punch assumes a first position away from said die, a second position in mated shearing engagement with said die, and a third position wherein said punch is adjacent to but spaced from said die and is in guiding relationship with said terminals; and (c) actuator means operable in a forward direction to an extended position and a reverse direction to a retracted position for effecting said reciprocating motion of said punch so that when said punch is in said first position said actuator means is in said retracted position, when said punch is in said third position said actuator means is in said extended position, and when said punch is in said second position said actuator means is between said retracted and extended positions.

2. The shear mechanism according to claim 1 wherein said actuator means includes a linear actuator having a movable member that moves from said retracted position to said extended position, a pair of toggle links each having one end pivotally attached to said movable member, the other end of one of the links being pivotally attached to said frame and the other end of the other of said links being pivotally attached to a lever for effecting said reciprocating motion.

3. The shearing mechanism according to claim 2 wherein the axes of said pivotal attachments to said frame and to said lever define a plane and wherein said toggle links are arranged so that when said punch is in said first position the axis of said pivotal attachment to said movable member is positioned on one side of said plane, when said punch is in said second position said axis is positioned coincident with said plane, and when said punch is in said third position said axis is on the opposite side of said plane.

4. The shearing mechanism according to claim 3 wherein said linear actuator is an air cylinder and said movable member is the piston rod of said air cylinder.

5. The shearing mechanism according to claim 3 including adjustable stop means for limiting said movement of said movable member when moving from said retracted position to said extended position thereby adjusting said spacing between said punch and die when said punch is in said third position.

6. The shearing mechanism according to claim 5 wherein said adjustable stop means includes a member attached to said frame and having a setscrew threaded thereinto in axial alignment with the axis of said piston rod and arranged so that said setscrew abuts said pivotal attachment to said movable member and prevents further movement thereof when said movable member is in said extended position.

7. The shearing mechanism according to claim 6 wherein said reciprocating motion of said punch is linear motion and wherein said lever is pivotally attached to said frame and is coupled to said punch and arranged to impart said linear reciprocating motion.

8. The shearing mechanism according to claim 7 wherein said lever is substantially L-shaped, said pivotal attachment to said frame being near the apex, and said coupling to said punch is at a first end of said lever.

9. The shearing mechanism according to claim 8 wherein said coupling to said punch comprises a plate attached to said punch having an elongated hole formed therethrough and a pin extending from said first end of said lever and projecting into said elongated hole, the longitudinal axis of said elongated hole and the axis of said pin being normal to said reciprocating motion.

10. The shearing mechanism according to claim 1 wherein said punch includes two plates spaced to straddle one of said terminals so that as said punch engages said die and moves into said second position said two plates sever the carrier strips from both sides of said one terminal thereby separating two terminals from said strip and as said punch retreats from said die to said third position said two plates guide said two separated terminals during insertion into said bobbin.

* * * * *